US010966522B2

(12) United States Patent
Sassano et al.

(10) Patent No.: US 10,966,522 B2
(45) Date of Patent: Apr. 6, 2021

(54) DRAWER LATCHING ASSEMBLY

(71) Applicant: International Business Machines Corporation, Armonk, NY (US)

(72) Inventors: Camillo Sassano, Durham, NC (US); William Risk, San Jose, CA (US); Benjamin Gordon Shaw, San Francisco, CA (US); Kevin L. Schultz, Raleigh, NC (US); Michael Vincent DeBole, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/515,286

(22) Filed: Jul. 18, 2019

(65) Prior Publication Data

US 2021/0015258 A1 Jan. 21, 2021

(51) Int. Cl.

| | |
|---|---|
| ***A47B 88/919*** | (2017.01) |
| ***E05B 3/00*** | (2006.01) |
| *A47B 88/938* | (2017.01) |

(52) U.S. Cl.

CPC ..... *A47B 88/919* (2017.01); *E05B 3/00* (2013.01); *A47B 2088/94* (2017.01)

(58) Field of Classification Search

CPC ..... A47B 88/919; A47B 97/00; E05B 3/00
USPC ..... 312/330.1, 332.1, 223.2
See application file for complete search history.

(56) References Cited

U.S. PATENT DOCUMENTS

| | | | | |
|---|---|---|---|---|
| 2,944,864 | A * | 7/1960 | Krivulka | E05B 65/46 312/332.1 |
| 3,039,837 | A * | 6/1962 | Poe | E05C 3/041 312/332.1 |
| 6,145,352 | A | 11/2000 | Vickers et al. | |
| 6,209,931 | B1 | 4/2001 | Von Stoutenborough et al. | |
| 7,604,308 | B2 | 10/2009 | Tseng et al. | |
| 8,737,078 | B2 | 5/2014 | Zhang et al. | |
| 9,758,996 | B2 | 9/2017 | Olsson et al. | |
| 10,129,999 | B2 | 11/2018 | Christenson et al. | |
| 2001/0027667 | A1 | 10/2001 | Pinkow et al. | |
| 2009/0168342 | A1* | 7/2009 | Tang | G06F 1/1616 361/679.58 |
| 2010/0019636 | A1* | 1/2010 | Chen | E05B 65/46 312/332.1 |
| 2011/0309730 | A1* | 12/2011 | Retchloff | E05C 3/14 312/332.1 |

(Continued)

*Primary Examiner* — James O Hansen
(74) *Attorney, Agent, or Firm* — Kunzler Bean & Adamson

(57) ABSTRACT

An apparatus includes a coupling rod having a longitudinal axis and disposed within one or more bearing elements that laterally constrain the coupling rod while enabling axial rotation, multiple latching barbs coupled to the coupling rod, rotational force elements that apply a rotational force to the latching barbs in a latching direction and resist rotation of the latching barbs in an unlatching direction. The apparatus may be deployed in a rack system having a rack drawer. The apparatus may also include barb engagement elements for engaging and latching the latching barbs when the rack drawer is moved from an open position to a closed position. Rotation of the coupling rod in the unlatching direction unlatches the latching barbs when the rack drawer is in the closed position and enables a user to open the rack drawer. A method that uses the apparatus is also disclosed herein.

14 Claims, 5 Drawing Sheets

(56) References Cited

U.S. PATENT DOCUMENTS

| | | | | |
|---|---|---|---|---|
| 2014/0265784 | A1 | 9/2014 | Russell et al. | |
| 2015/0061483 | A1 * | 3/2015 | Liu | E05B 65/46 312/332.1 |

* cited by examiner

DRAWER LATCHING ASSEMBLY

STATEMENT REGARDING FEDERALLY SPONSORED RESEARCH OR DEVELOPMENT

This invention was made with government support under A1669657 awarded by U.S. Air Force, Office of Scientific Research. The government has certain rights in the invention.

BACKGROUND

The subject matter disclosed herein relates generally to storage racks and cabinets and, in particular, to latching mechanisms for drawers of storage racks and cabinets.

Maintenance personnel are often required to install or access equipment stored in drawers and mounted on storage racks via sliding rails. Typically, two hands are required to unlatch and open the drawers to access the equipment.

SUMMARY OF THE INVENTION

In one embodiment, an apparatus includes a coupling rod having a longitudinal axis and disposed within one or more bearing elements that laterally constrain the coupling rod while enabling axial rotation as well as multiple latching barbs coupled to the coupling rod. The apparatus may also include rotational force elements corresponding to the latching barbs that apply a rotational force to the latching barbs in a latching direction and resist rotation of the latching barbs in an unlatching direction. The apparatus may be deployed in a rack system having a rack drawer. The apparatus may also include barb engagement elements for engaging and latching the latching barbs when the rack drawer is moved from an open position to a closed position. Rotation of the coupling rod in the unlatching direction unlatches the latching barbs from the corresponding barb engagement members when the rack drawer is in the closed position and enables a user to open the rack drawer. A method that uses the aforementioned apparatus is also disclosed herein.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The embodiments disclosed herein recognize that rack mounted drawers may require latches disposed at multiple positions (i.e., latching points) in order to properly secure the drawers and prevent damage to the drawers and the associated equipment. The embodiments disclosed herein also recognize that manually unlatching multiple latches may require a high level of manual dexterity and often slows down the maintenance process particularly when many drawers need to be opened.

Figure 1:
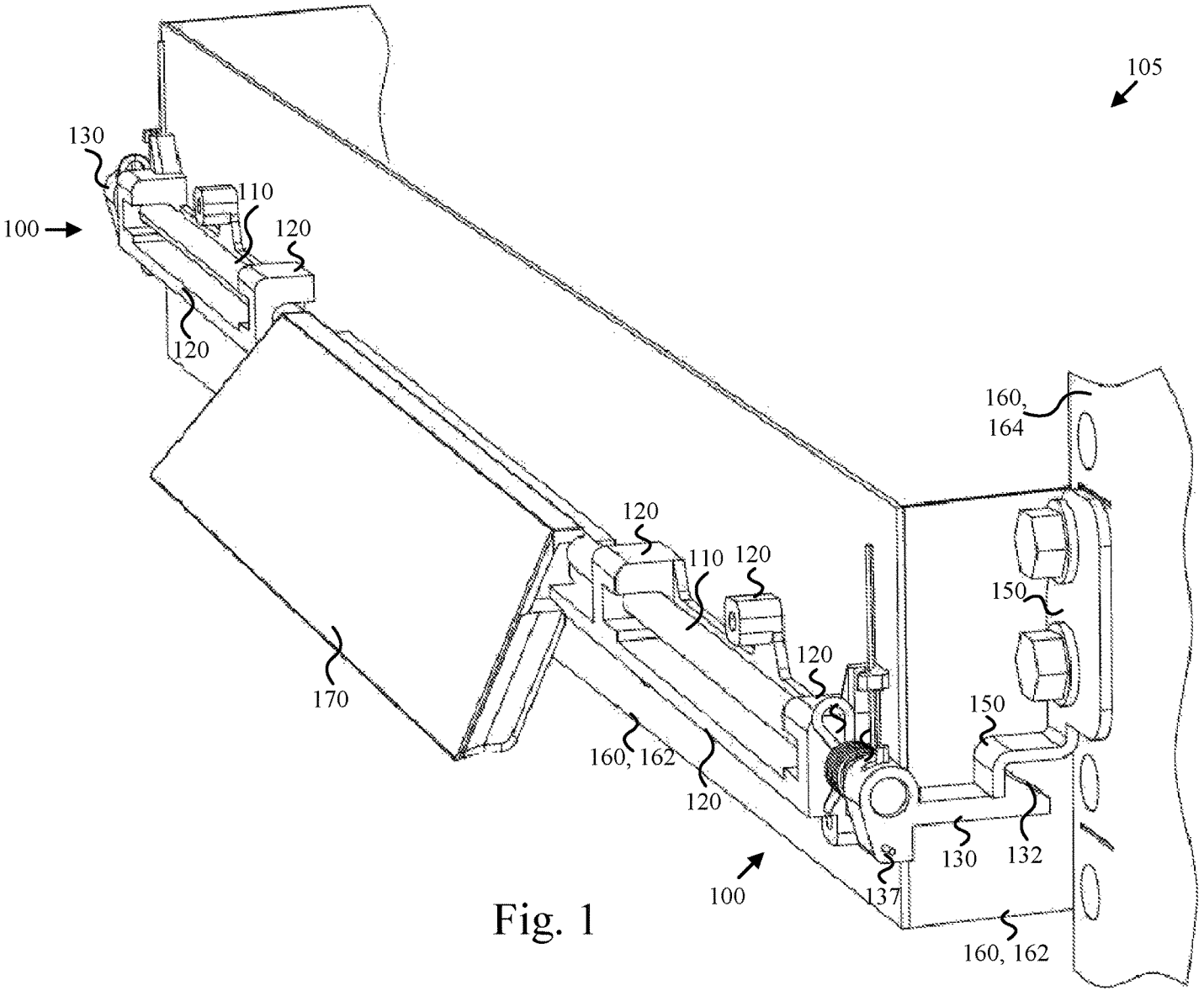
FIG. 1 is a perspective view drawing of one example of a drawer latching assembly and rack system in accordance with at least one embodiment disclosed herein.
Figure 2:
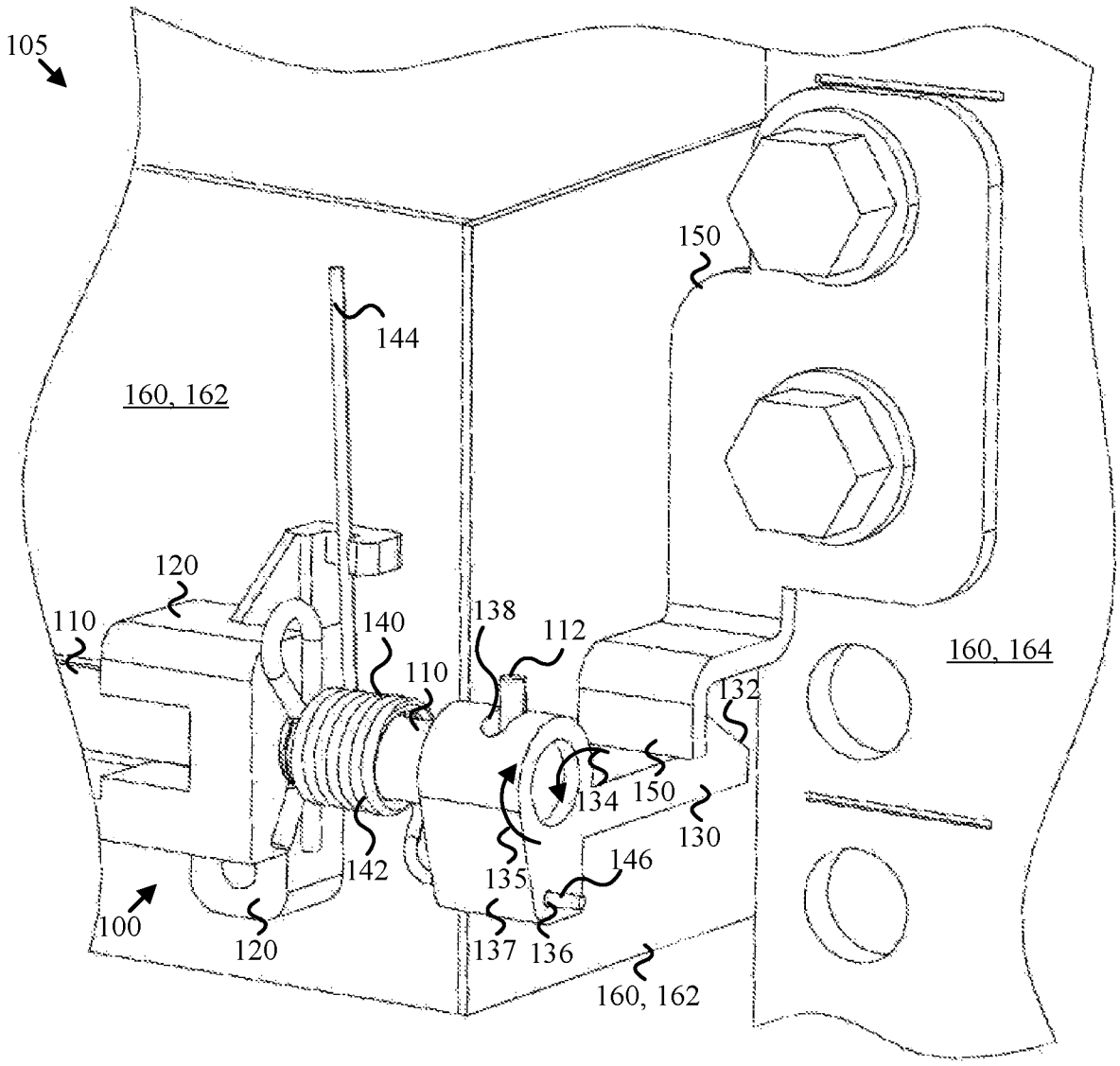
FIG. 2 is a perspective view drawing of one example of selected portions of the drawer latching assembly and rack system of FIG. 1 in accordance with at least one embodiment disclosed herein.

FIGS. 1 and 2 are perspective view drawings of one example of a drawer latching assembly 100 and rack system 105 in accordance with at least one embodiment disclosed herein. FIG. 2 shows selected elements of the latching assembly 100 and rack system 105 in greater detail than FIG. 1.

As depicted, the drawer latching assembly 100 includes a coupling rod 110, one or more bearing elements 120 as well as multiple latching barbs 130, rotational force elements 140 and barb engagement elements 150. The elements of the depicted drawer latching assembly 100 may be attached to various rack elements 160 of a rack system 105. Examples of rack elements 160 include a rack drawer 162, rack support elements (e.g., a frame) 164 and rack walls 166 (not shown in FIGS. 1 and 2 but shown in FIGS. 3A-3D and 4A-4B).

The drawer latching assembly 100 enables single-handed opening and closing of a rack drawer 162 by a user while providing multiple latching/securement points for the rack drawer 162 when the rack drawer 162 is closed. The coupling rod 110 couples to the latching barbs 130 such that axial rotation of the coupling rod 110 along the longitudinal axis engages or disengages the latching barbs 130 from the barb engagement elements 150 as needed. The bearing elements 120 laterally and vertically constrain the coupling rod 110 while enabling axial rotation of the coupling rod 110.

The latching barbs 130 engage with, and latch to, the barb engagement elements 150 when the rack drawer 162 is moved from an open position to a closed position. The latching barbs 130 include a sloped engagement surface 132 that causes deflection and partial rotation of the latching barbs 130 as the rack drawer 162 is closed.

The rotational force elements 140 apply a rotational force to the latching barbs 130 in a latching direction 134 and resist rotation of the latching barbs 130 in an unlatching direction 135. Application of the rotational force holds the latching barbs 130 against the barb engagement elements 150 unless a sufficient rotational force is applied to the coupling rod 110 in the unlatching direction 135 that moves the latching barbs 130 away from the barb engagement elements 150.

The depicted drawer latching assembly 100 includes a rotation enablement element 170 that is fixedly attached to the coupling rod 110. The rotation enablement element 170 enables a user to rotate the coupling rod 110 about the longitudinal axis and overcome the rotational force applied by the rotational force elements 140 and thereby unlatch the latching barbs 130 from the barb engagement elements 150. In addition to unlatching, the depicted rotation enablement element 170 may also be used to pull the rack drawer 162 open and push the rack drawer 162 closed. In the depicted arrangement, the rotation enablement element 170 can be a handle. However, the rotation enablement element 170 is not limited to a handle and may be a lever, a gear, or the like.

As shown in FIG. 1 and with greater detail in FIG. 2, the rotational force elements 140 can be torsional springs 142 wrapped around the coupling rod 110. A first end 144 of the torsional springs 142 engage (push against) a front of the rack drawer 162 or a bearing element 120 attached thereto while a second end 146 of the torsional springs 142 attaches to one of the latching barbs 130. As shown in detail in FIG. 2, the second end 146 of the torsional spring 142 is disposed within a receiving hole 136 within a force application arm 137 of the latching barb 130. The depicted arrangement enables the torsional spring 142 to apply a rotational force to the latching barb 130 in the latching direction 134.

In some embodiments, the coupling rod 110 is slippably coupled to the latching barbs 130 and the latching barbs 130 comprise slip-limiting slots 138. Stop pins 112 may be fixably attached to the coupling rod 110 and protrude into (and optionally completely through) the slip-limiting slots 138. For example, the stop pins 112 may be inserted into receiving holes (not shown) on the coupling rod 110. The stop pins 112 may move synchronously with rotation of the coupling rod 110 and limit the rotational slippage of the coupling rod 110 relative to the latching barbs 130. For example, when the stop pins 112 engage one of the ends of the slip-limiting slots 138 further rotational slippage of the coupling rod 110 in that particular direction will be prevented, resulting in rotational movement of the latching barbs 130 with further rotational movement of the coupling rod 110.

Figure 3A:
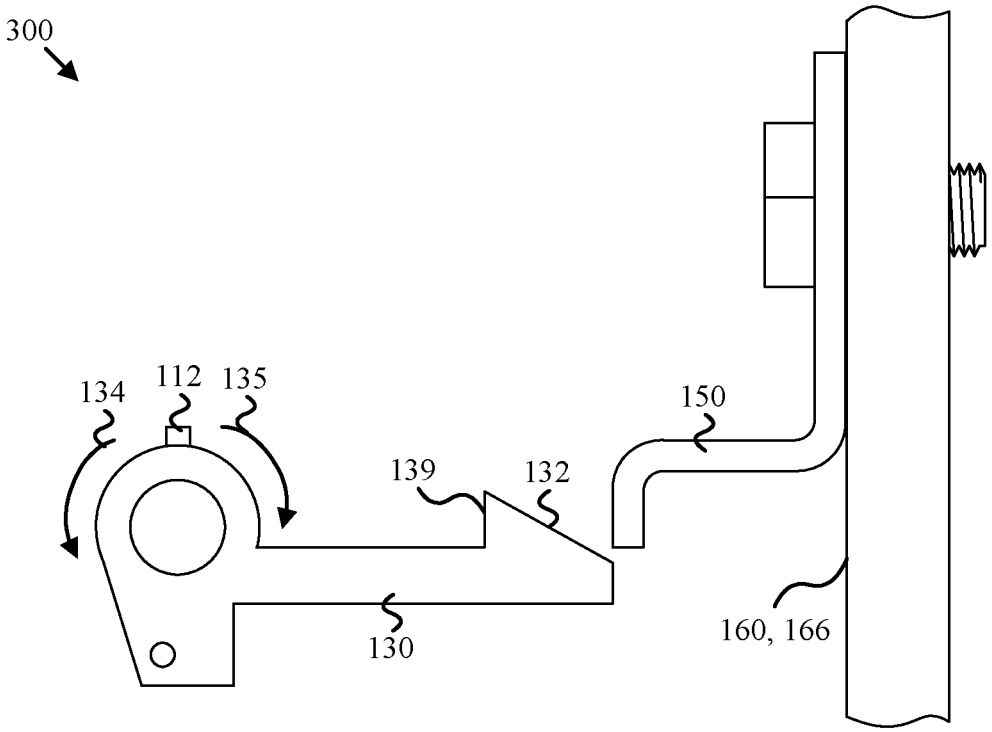
FIGS. 3A-3D are cross-sectional side view drawings of selected elements of the drawer latching assembly of FIG. 1 as a rack drawer is moved from an open position to a closed position and then unlatched.
Figure 3B:
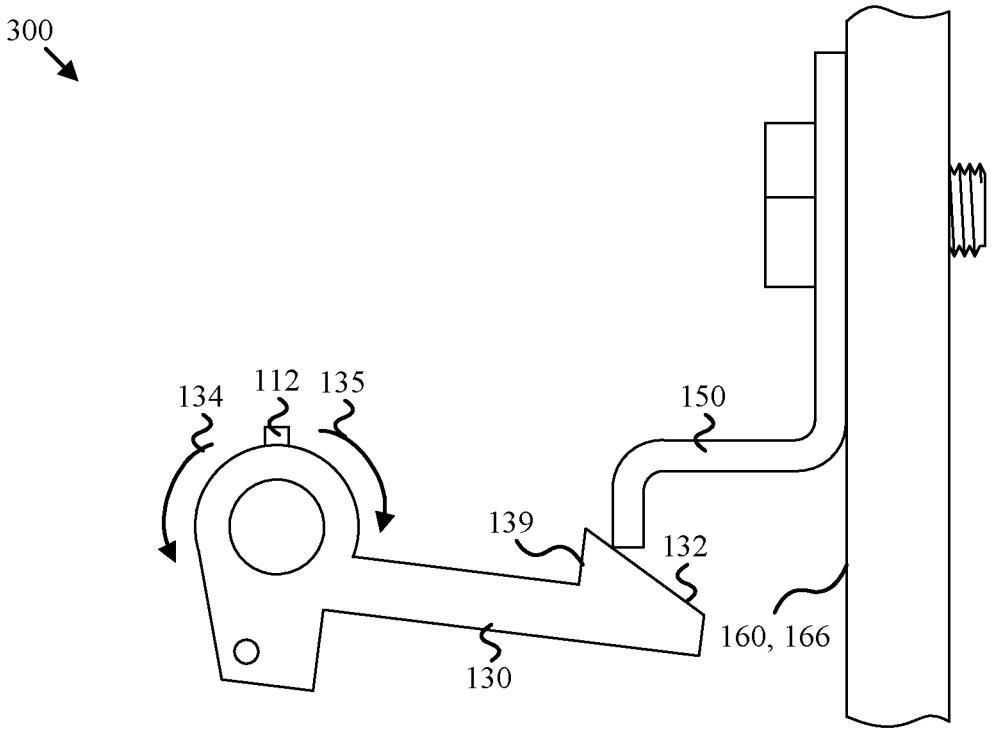

FIGS. 3A-3D are cross-sectional side view drawings of selected elements 300 of the drawer latching assembly 100 and rack system 105 of FIG. 1 as the rack drawer 162 is moved from an open position to a closed position and then unlatched. Referring to FIGS. 3A-3D while continuing to refer to FIGS. 1 and 2, pushing (e.g., via the rotation engagement element or handle 170) the rack drawer 162 from an open position shown in FIG. 3A to a closed position shown in FIG. 3C causes the sloped engagement surfaces 132 of the latching barbs 130 to engage the barb engagement elements 150 as shown in FIG. 3B. Engagement of the barb engagement surfaces 132 with the barb engagement elements 150 may cause a partial rotation of the latching barbs 130 in the unlatching direction 135.

Figure 3C:
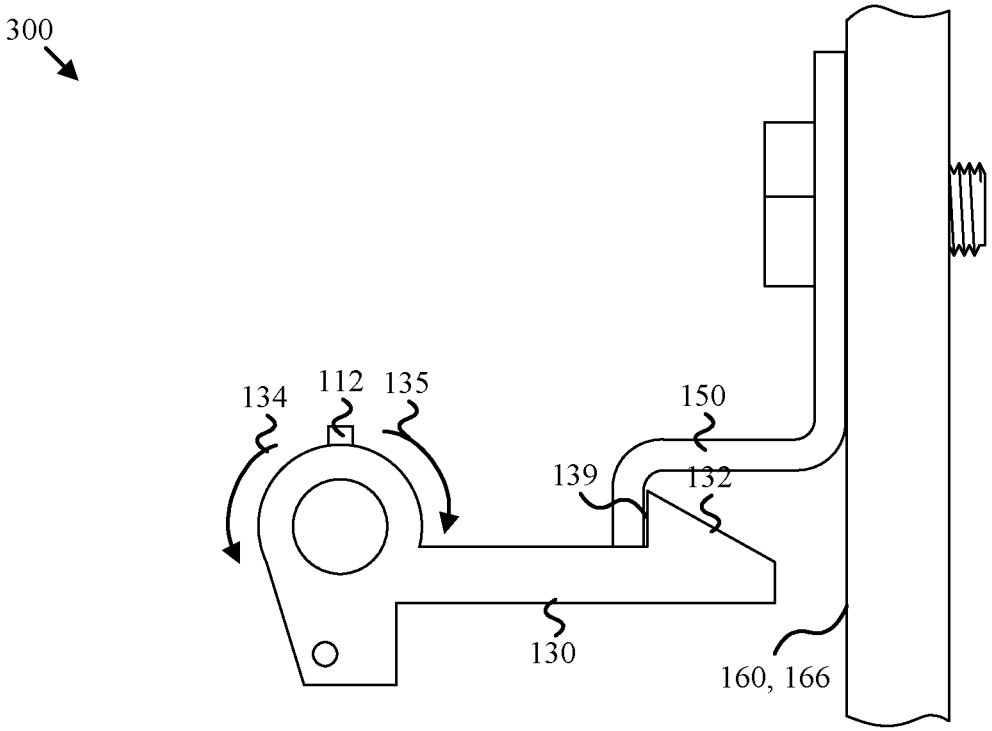
Figure 3D:
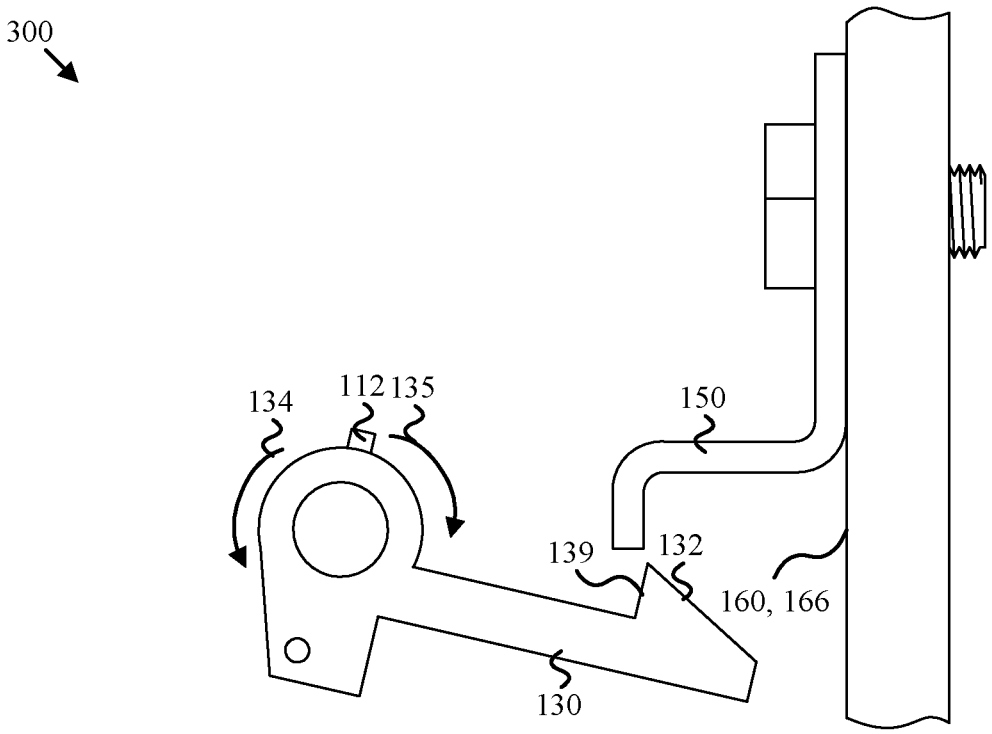

As shown in FIG. 3C, once the sloped engagements surfaces 132 are past the barb engagement elements 150, barb drops 139 on the latching barbs 130 enable further rotation of the latching barbs 130 in the latching direction 134 by the rotational force elements 140 (not shown in FIGS. 3A-3D) resulting in the latching barbs 130 (and thereby the rack drawer 162) being latched to the barb engagement elements 150. The additional rotation of the latching barbs 130 provided by the rotational force elements 140 prevents the rack drawer 162 from being opened unless the latching barbs 130 are rotated sufficiently in the unlatching direction 135 by the rotation enablement element 170 via the coupling rod 110 as shown in FIG. 3D.

Sufficient rotation of the latching barbs 130 in the unlatching direction 135 rotates the barb drops 139 downward past the lower edge of the of the barb engagement elements 150 and enables the user to open the rack drawer 162. Rotation of the latching barbs 130 in the unlatching direction 135 may occur when the stop pin 112 contacts the end of the slip limiting slot 138 (not shown in FIGS. 3A-3D) due to rotational movement of the coupling rod 110 by the user via the rotation enablement element (e.g., a handle) 170. Continued rotational movement (with sufficient rotational force to overcome the rotational force elements 140) results in the barb drops 139 and sloped engagements surfaces 132 rotating below the lower edges of the barb engagement elements 150. When the barb drops 139 and sloped engagements surfaces 132 are below the lower edges of the barb engagement elements 150 the user can pull the rack drawer to an open position corresponding to FIG. 3A or the like.

In some embodiments, the length of the slip-limiting slots 138 is selected to correspond to the height of the barb drops 139. Having the coupling rod slippably coupled to the latching barbs 130 and selecting the length of the slip-limiting slots 138 to correspond to the height of the barb drops 139 enables the user to close the rack drawer 162 and move the sloped engagement surfaces 132 under and past the barb engagement elements 150 as shown in FIGS. 3B and 3C without requiring the user to rotate the coupling rod 110 in the unlatching direction. Rather, the sloped engagement surfaces 132 cause the latching barbs 130 to rotate in the unlatching direction 135 without imposing a significant force onto the coupling rod 110 in the unlatching direction 135. Consequently, the rack drawer 162 may be closed without causing movement of the rotation enablement element (e.g., handle) 170 in the unlatching direction 135.

Figure 4A:
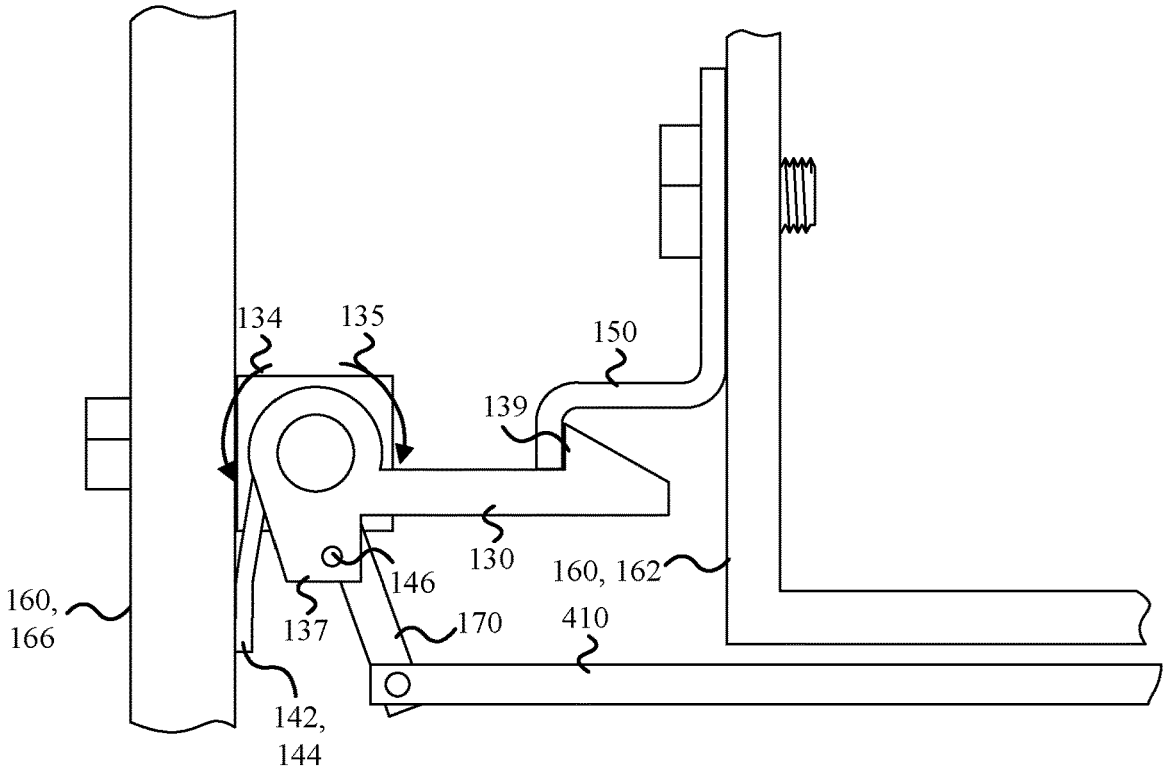
FIGS. 4A and 4B are cross-sectional side view drawings of one example of an alternate deployment of the drawer latching assembly of FIGS. 1 and 2 in accordance with at least one embodiment disclosed herein.
Figure 4B:
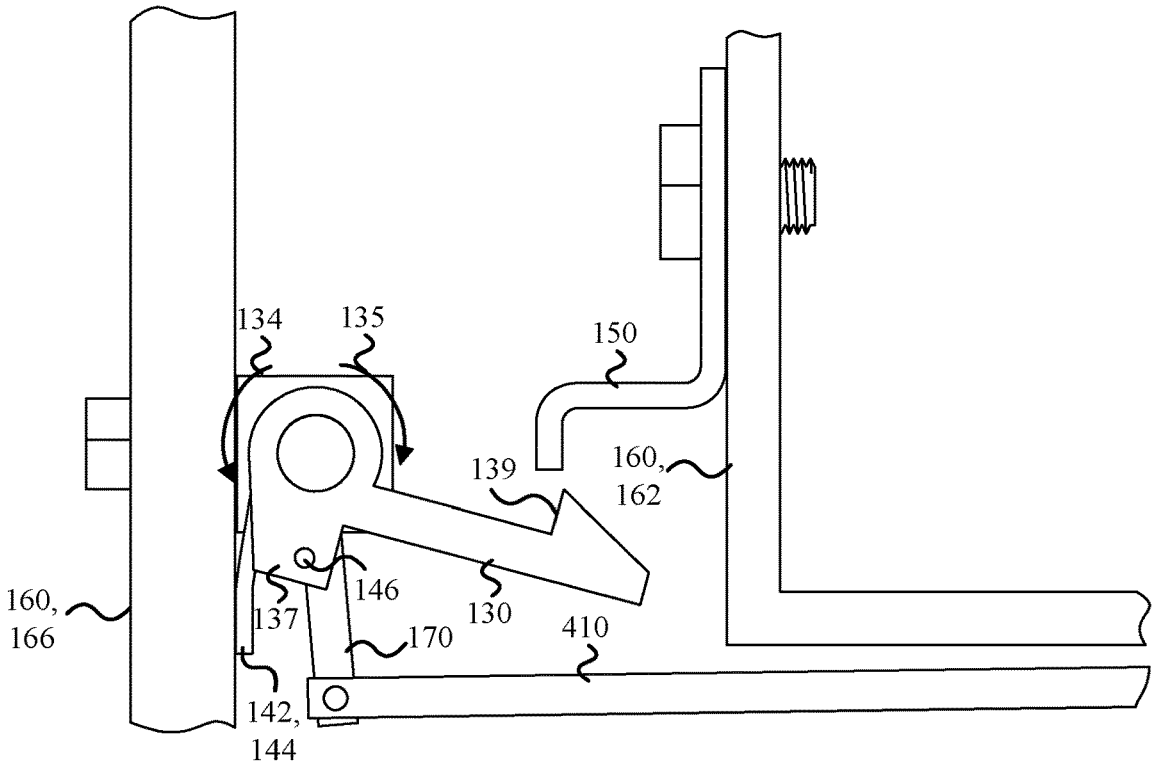

Referring now to FIGS. 4A and 4B as well as FIG. 1, the rack elements 160 may include support elements (e.g., a frame) 164 and rack walls 166 (not shown in FIG. 1) in addition to the rack drawer 162. In the embodiment depicted in FIG. 1, the bearing elements 120 are fixably attached to the rack drawer 162 and the barb engagement elements 150 are fixably attached to corresponding rack support elements (e.g., the frame) 164. Alternately, the barb engagement elements 150 may be fixably attached to a rack wall 166.

In the embodiment depicted in FIGS. 4A and 4B, the bearing elements 120 are fixably attached to the rack wall 166 (disposed at the rear of the rack system) and the barb engagement elements 150 are fixably attached to the rack drawer 162. The first end 144 of the torsional spring 142 depicted in FIGS. 4A and 4B engages (pushes against) the rack wall 166 while the second end 146 of the torsional spring 142 attaches or connects to the force application arm 137 and provides a rotational force to the latching barb 130 in the latching direction 134.

In FIG. 1, the rotation enablement element 170 is a handle. In contrast, the rotation enablement element 170 depicted in FIGS. 4A and 4B is a lever that is connected to an unlatching rod 410. The unlatching rod 410 or an element connected thereto may be manipulated by a user to move the rotation enablement element 170 in the unlatching direction 135. Moving the rotation enablement element 170 in the unlatching direction 135 may result in rotation of the coupling rod 110 and all of the latching barbs 130 coupled thereto. The latching barbs 130 may rotate from a latched position shown in FIG. 4A to an unlatched position shown in FIG. 4B and enable the user to open the rack drawer 162.

One of skill in the art will appreciate that the embodiments disclosed herein provide multiple points of securement for closed rack drawers while enabling a user to open and close those drawers with a single hand. For example, an enterprise that obtains or provides a rack system 105 having one or more drawer latching assemblies 100 may dispatch a user such as a service technician to service equipment held by the rack system 105. The user may pull or otherwise activate the rotation engagement element 170 with a single hand and cause rotation of the coupling rod in the unlatching direction and thereby unlatch the latching barbs 130 from the barb engagement elements 150. The user may then open the rack drawer 162 by continuing to pull or otherwise activate the rotation engagement element 170. Subsequently, the user may service equipment contained in the rack drawer 162.

The features, advantages, and characteristics of the embodiments described herein may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The description of elements in each figure may refer to elements of proceeding figures. Like numbers refer to like elements in all figures, including alternate embodiments of like elements. The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An assembled rack system comprising a rack drawer and a rack wall or frame, the assembled rack system further comprising:

a coupling rod having a longitudinal axis, the coupling rod disposed within one or more bearing elements fixably attached to the rack drawer, each bearing element thereof configured to laterally constrain the coupling rod while enabling axial rotation of the coupling rod;

a plurality of latching barbs slippably coupled to the coupling rod;

a corresponding plurality of rotational force elements collectively configured to apply a rotational force to the plurality of latching barbs in a latching direction and resist rotation of the plurality of latching barbs in an unlatching direction;

a corresponding plurality of barb engagement elements, fixably attached to the rack wall or frame, for engaging and latching the plurality of latching barbs when the rack drawer is moved from an open position to a closed position; and wherein rotation of the coupling rod in the unlatching direction unlatches each of the plurality of latching barbs from the corresponding barb engagement member when the rack drawer is in the closed position and enables a user to open the rack drawer.

2. The apparatus of claim 1, further comprising a rotation enablement element fixedly attached to the coupling rod that enables rotation of the coupling rod about the longitudinal axis.

3. The apparatus of claim 2, wherein the rotation enablement element comprises a handle or lever.

4. The apparatus of claim 3, wherein pulling the handle or lever unlatches the plurality of latching barbs and moves the drawer from the closed position to the open position.

5. The apparatus of claim 1, wherein a rotational force element of the corresponding plurality of rotational force elements comprises a torsional spring.

6. The apparatus of claim 1, wherein each of the plurality of latching barbs comprises a slip-limiting slot.

7. The apparatus of claim 6, further comprising a stop pin disposed within each slip-limiting slot and fixably attached to the coupling rod.

8. The apparatus of claim 7, wherein each stop pin moves within the corresponding slip-limiting slot in response to rotation of the coupling rod relative to the latching barb.

9. The apparatus of claim 8, wherein each stop pin and corresponding slip-limiting slot collectively limit rotational slippage of the coupling rod relative to the latching barb.

10. A method comprising:

providing the rack system of claim 1; and unlatching the plurality of latching barbs by causing rotation of the coupling rod in the unlatching direction.

11. The method of claim 10, further comprising opening the rack drawer to service equipment contained therein.

12. The method of claim 10, wherein the apparatus further comprises a rotation enablement element fixedly attached to the coupling rod that enables rotation of the coupling rod about the longitudinal axis.

13. The method of claim 12, wherein the rotation enablement element comprises a handle or lever.

14. The method of claim 13, wherein pulling the handle or lever unlatches the plurality of latching barbs and moves the drawer from the closed position to the open position.

* * * * *